US006370699B1

(12) United States Patent
Halstead et al.

(10) Patent No.: US 6,370,699 B1
(45) Date of Patent: Apr. 16, 2002

(54) JAW PAD FOR HELMET

(75) Inventors: P. David Halstead; Cherie F. Alexander, both of Knoxville, TN (US)

(73) Assignee: Southern Impact Research Center, LLC, Knoxville, TN (US)

( * ) Notice: Subject to any disclaimer, the term of this patent is extended or adjusted under 35 U.S.C. 154(b) by 0 days.

(21) Appl. No.: 09/779,865

(22) Filed: Feb. 8, 2001

(51) Int. Cl.[7] ..... A42B 3/00; A41D 27/26
(52) U.S. Cl. ..... 2/414; 2/267
(58) Field of Search ..... 2/425, 414, 411, 2/412, 267

(56) References Cited

U.S. PATENT DOCUMENTS 3,829,900 A * 8/1974 Marangoni
4,282,610 A * 8/1981 Steigerwald et al.
4,566,137 A * 1/1986 Gooding
4,575,874 A 3/1986 Johnson
4,831,668 A * 5/1989 Schulz
5,829,170 A 11/1998 Lutz, Jr.
5,890,244 A 4/1999 Cartwright et al.
6,185,753 B1 * 2/2001 Arai

* cited by examiner

*Primary Examiner*—Rodney M. Lindsey
(74) *Attorney, Agent, or Firm*—Luedeka, Neely & Graham PC

(57) ABSTRACT

A pad including a member provided by a substantially rigid sheet material having a crease formed therein to define first and second member portions that are yieldably positionable relative to one another about the crease and within a defined range of motion, a cushion secured adjacent the first member portion opposite the second member portion, and a covering substantially encasing the yieldable member and the cushion.

16 Claims, 5 Drawing Sheets

JAW PAD FOR HELMET

FIELD OF THE INVENTION

This invention relates generally to pads. More particularly, this invention relates to a jaw pad for use with a helmet.

BACKGROUND AND SUMMARY OF THE INVENTION

Football helmets typically include pads positioned adjacent the jaw area of a user. These pads are generally foam encased in a plastic covering material. There remains a need in the art for an improved construction for pads in general and, in particular, pads for placement adjacent the jaw area of a user.

Accordingly it is an object of the present invention to provide an improved pad.

Still another object of the present invention is to provide a pad for use with a helmet.

Yet another object of the invention is to provide a pad of the character described that is suitable for protecting the jaw area of a user.

A still farther object of the invention is to provide a pad of the character described that is economical to produce and uncomplicated in configuration.

With regard to the foregoing and other objects, the present invention is directed to a pad.

In a preferred embodiment, the pad includes a member provided by a substantially rigid sheet material having a crease formed therein to define first and second member portions that are yieldably positionable relative to one another about the crease and within a defined range of motion, a cushion secured adjacent the first member portion opposite the second member portion, and a covering substantially encasing the yieldable member and the cushion.

In another aspect, the invention relates to a helmet having such a pad.

In still another aspect, the invention relates to a method for making a pad.

In a preferred embodiment, the method includes the steps of providing a yieldable member provided by a donut-shaped portion of a substantially rigid, bendable sheet material, forming a crease yieldable member to substantially bisect the yieldable member and defme a pair of member portions that are yieldably positionable relative to one another about the crease; securing a cushion to an outward facing portion of one of the member portions and encasing the thus formed combination of the yieldable member and cushion within a covering material.

BRIEF DESCRIPTION OF THE DRAWINGS

Further advantages of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
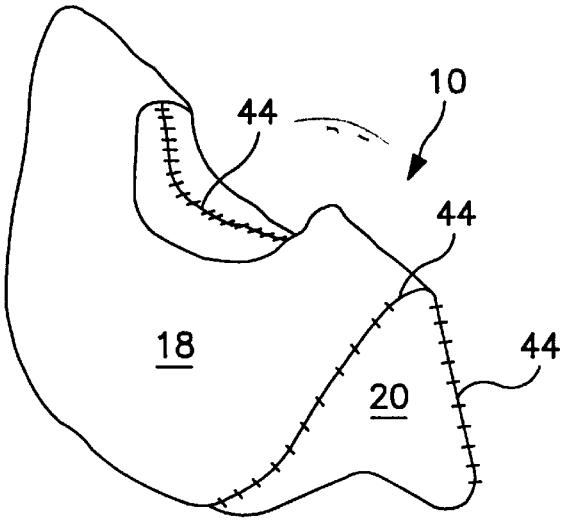
FIG. 1 is a front perspective view of a jaw pad in accordance with a preferred embodiment of the invention.
Figure 2:
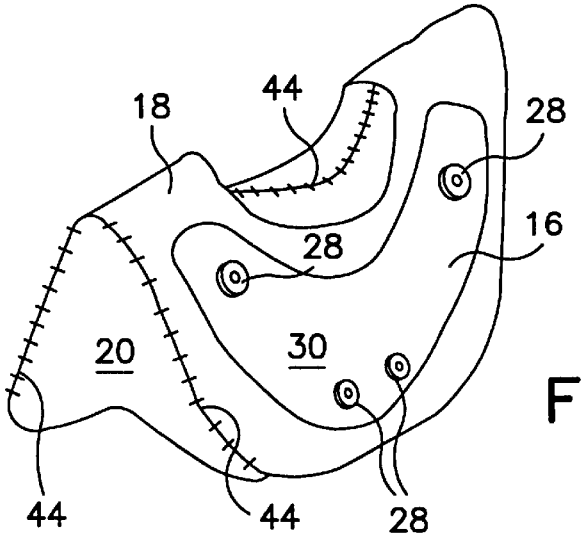
FIG. 2 is a rear perspective view of the pad of FIG. 1.
Figure 3:
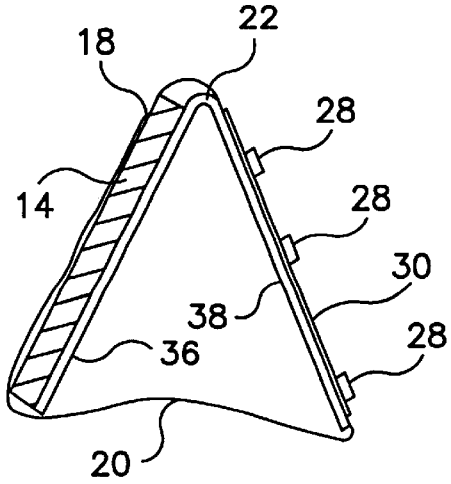
FIG. 3 is a cross-sectional end view of the pad of FIG. 1.
Figure 5:
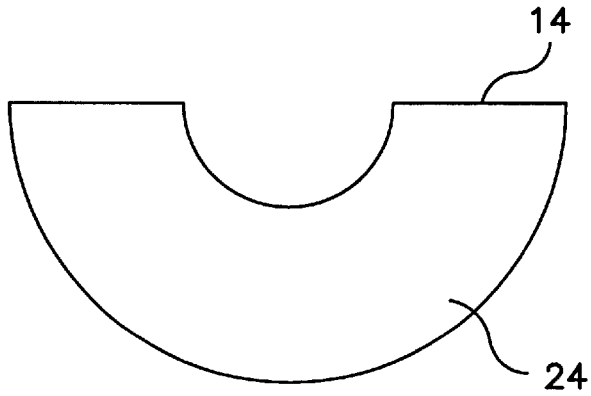
FIG. 5 is a side plan view of a padding component of the pad of FIG. 1.
Figure 6:
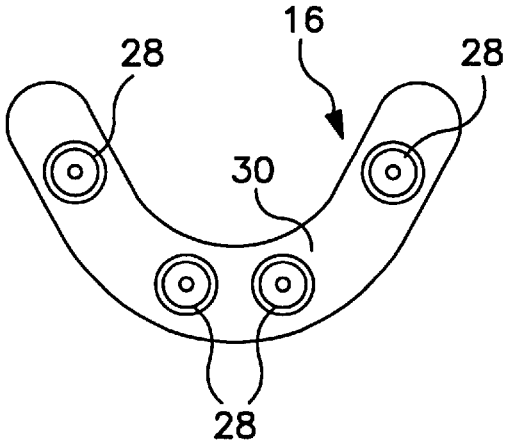
FIG. 6 is a side plan view of an attachment component of the pad of FIG. 1.
Figure 7:
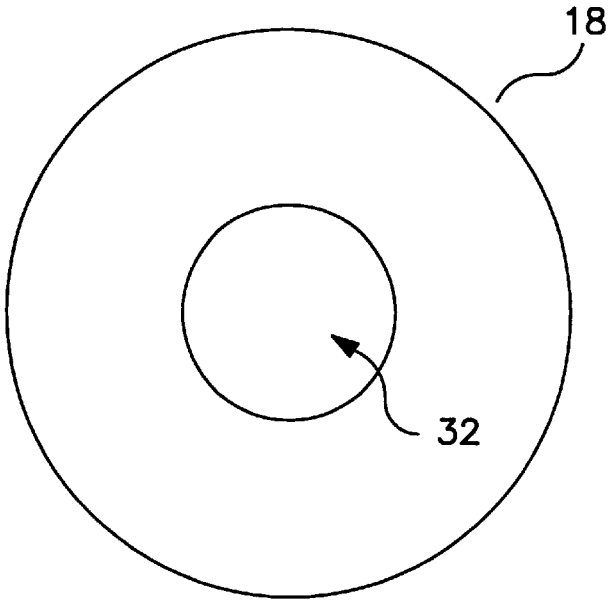
FIGS. 7 and 8 are plan views of covering components of the pad of FIG. 1.
Figure 8:
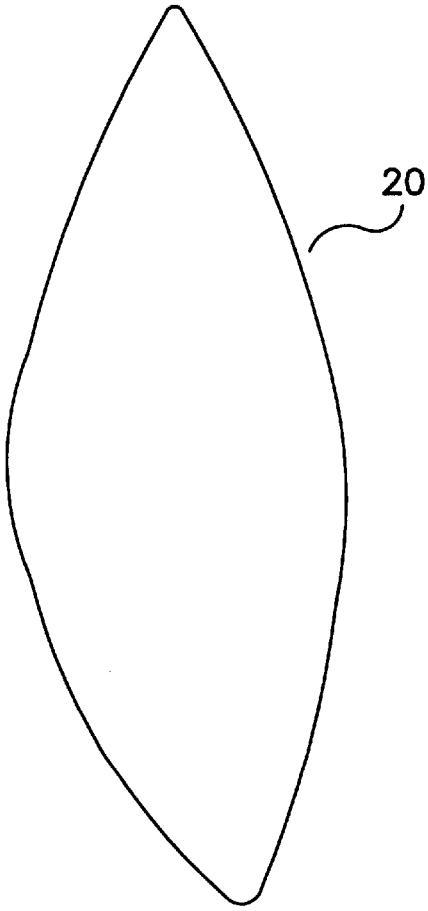
Figure 9A:
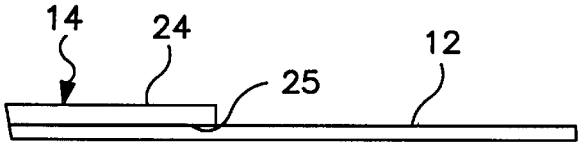
FIGS. 9*a*–9*d* show preferred steps in the manufacture of the pad of FIG. 1.
Figure 9B:
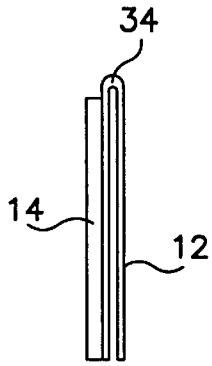
Figure 9C:
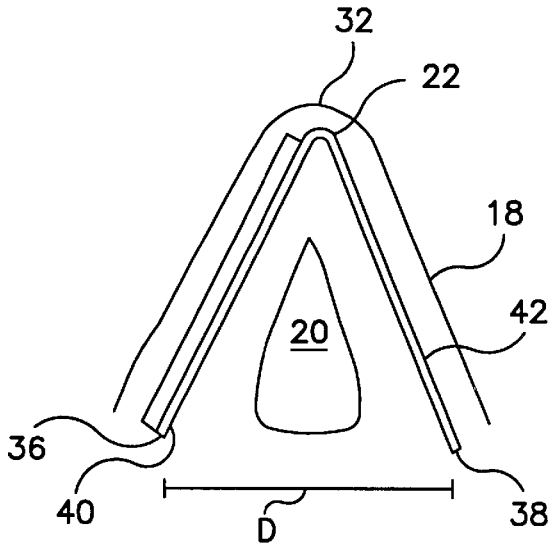
Figure 9D:
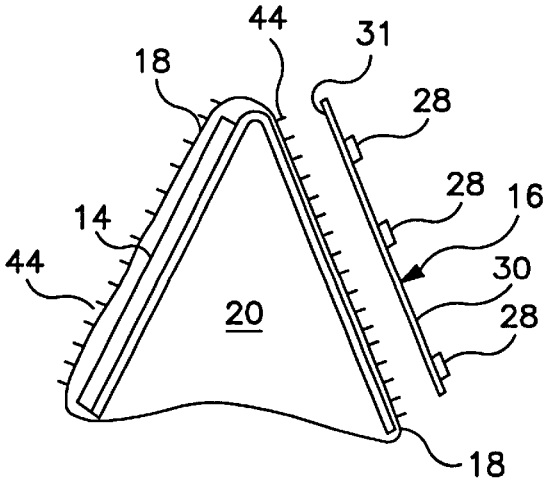

With reference to FIGS. 1–3, the invention relates to a pad 10 that is particularly suitable for use with a sporting helmet, such as a football helmet. The pad includes as its components a disk 12 (FIG. 4) of a polymeric material, a cushion 14 (FIG. 5), attachment member 16 (FIG. 6) and covering portions 18 (FIG. 7) and 20 (FIG. 8).

Figure 4:
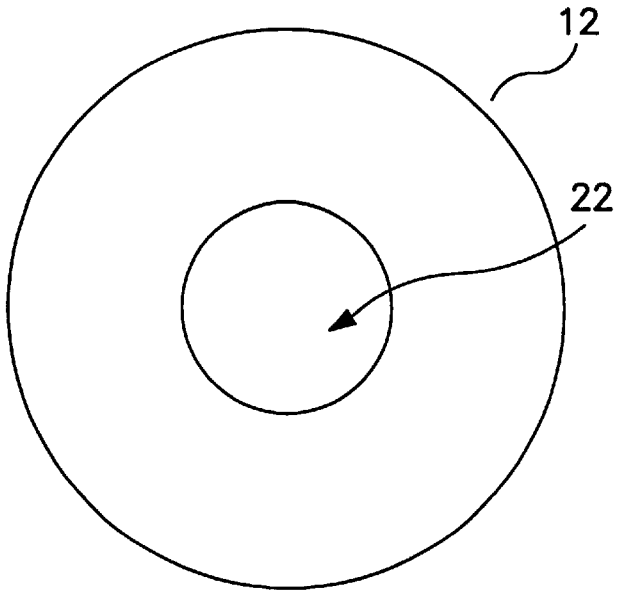
FIG. 4 is a top plan view of a disk component of the pad of FIG. 1.

The disk 12 is preferably a donut-shaped portion of a substantially rigid plastic material, preferably having a thickness of from about 1/32 to about 3/32 of an inch, most preferably about 1/16 of an inch. The disk 12 is preferably elliptical (egg-shaped) or circular (as shown in FIG. 4). For an elliptical disk, it is preferred that the major diameter is from about 4 to about 6 inches, most preferably about 5 inches, and the minor diameter is from about 4 to about 4½ inches, most preferably about 4¼ inches. For a circular disk 12, the disk 12 preferably has a diameter of from about 4 to about 6 inches, most preferably about 5 inches.

The disk 12 further includes a central cutout portion 22 that is preferably either elliptical or circular, with its diameter dimensions ranging from about 2 to about 4 inches, most preferably about 2½ inches for a circular cutout portion. An elliptical cutout portion preferably has a major diameter of about 2½ inches and a minor diameter of about 2 inches.

The cushion 14 is preferably a half-circle of a foam material having a thickness of from about ⅛ to about ½ inch, most preferably about ¼ inch. The cushion 14 is sized to overlie approximately one-half of the disk 12 and includes opposite face surfaces 24 and 25, one of which is preferably securable, as by adhesive, to the disk 12.

The attachment member 16 is preferably provided by a U-shaped strip of a flexible sheet material, such as a plastic material 26, onto which is secured a plurality of snap members 28 configured to matingly engage corresponding snap members affixed to an inner surface of a helmet with which the pad is to be used. For example, the snap members 28 may be female snap members for engaging male snap members on the helmet. The plastic material 26 has opposite sides 30 and 31. The snap members 28 have two portions, one of which is positioned on either side of the plastic material, and press-fit together to secure the snap members 28 to the plastic material 26. The attachment member 16 is secured to the pad 10 by securing the side 31 to a portion of the covering 18.

The covering portions 18 and 20 are provided by portions of a flexible sheet material, such as vinyl. The portion 18 is preferably circular or elliptical in shape and the portion 20 is generally diamond-shaped.

The portion 18 further includes a central cutout portion 32 that is preferably either elliptical or circular.

With reference to FIGS. 9*a*–9*d*, the pad 10 is preferably assembled by folding the disk 12 (with the cushion 14 secured thereto) about its center-line to impart a crease 34 at the center-line of the disk 12. The crease 34 remains, with the disk relaxing in the absence of pressure so that free edges 36 and 38 of the disk 12 are spaced a distance D of from about 1½ to about 2½ inches. Accordingly, imparting the crease 34 renders the disk 12 bent to provide sides 40 and 42 which are yieldably positionable relative to one another.

The thus assembled pad 10 is then enclosed within a covering provided by the covering portions 18 and 20. With the disk 12 squeezed together so that the distance D is slightly less than its fully relaxed dimension, the covering portions 18 and are positioned around the disk 12 and sewn as by stitching 44 or otherwise joined together so that the disk 12 is fully encased. In this regard, the portion 18 is preferably positioned so that the cutout 32 overlies the cutout 22 of the disk. As will be appreciated, the portion 18 substantially overlies the flat surfaces of the disk 12. The portion 20 is positioned to that it extends around the remaining exposed portion of the disk 12. The meeting edges of the covering portions 18 and 20 are then secured together, as by stitches, and the cutout 32 closed as by stitching the edges thereof together. The attachment member 16 is then secured to a portion of the covering portion 18 opposite the cushion 14, as by adhesively securing the side 31 to the covering.

Figure 10:
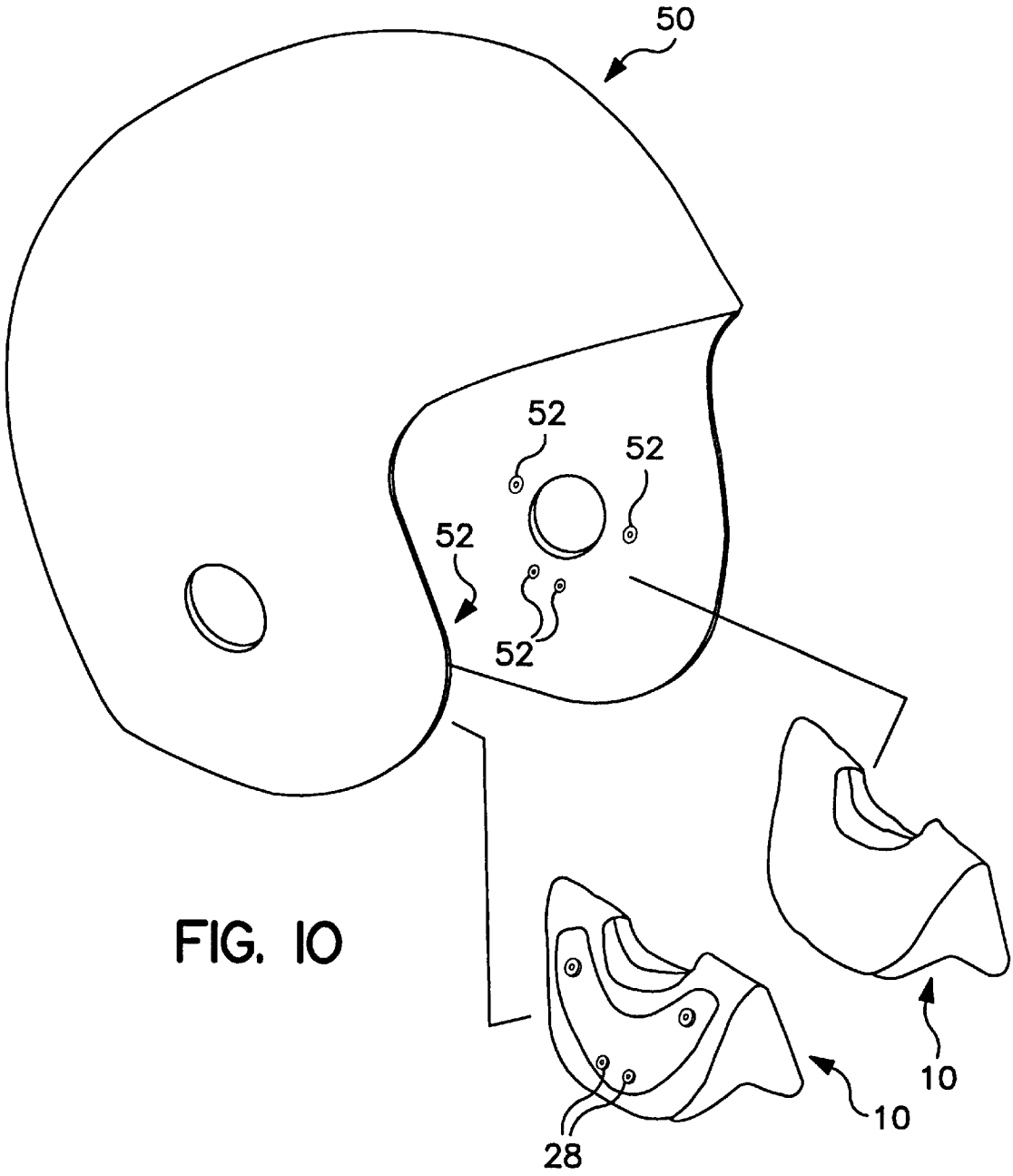
FIG. 10 is an exploded perspective view showing a helmet and jaw pads in accordance with the invention.

Turning to FIG. 10, the assembled pad 10 may then be installed on a helmet 50. The helmet 50 preferably includes attachment members 52 secured to an inner surface of the helmet adjacent portions of the helmet interior so that they will be adjacent jaw areas of a user wearing the helmet. The female snap members 28 frictionally engage the male members 52 to enable the pad 10 to be retained in position on the helmet.

As will be appreciated, the sides 40 and 42 of the assembled pad 10 are yieldably positionable relative to one another within a range of motion defined by the relative positions of the edges 36 and 38. That is, in the absence of pressure upon the pad, the distance D between the edges 36 and 38 will be their relaxed distance, or slightly less, if the covering is installed in a manner which slightly urges or squeezes the edges toward one another. This distance is preferably from about 1½ to about 2 ½ inches for a jaw pad for use with an adult-sized football helmet.

As will be appreciated, the crease will tend to maintain the edges 36 and 38 at their maximum spacing. When a force is exerted upon the pad, as by a user receiving force applied to the jaw area of the helmet, this force will tend to urge the sides 36 and 38 toward one another. Thus, force is transferred to overcome the bias of the crease 22 and urge the sides 40 and 42 toward one another. In the presence of sufficient force, the sides 40 and 42 will contact one another so that the relative spacing between the edges 36 and 38 is zero. At this point, in the presence of sufficient force to overcome the compressive resistance of the cushion, the cushion may compress further absorbing force and reducing force applied to the jaw of the user.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A pad, comprising:

a member provided by a substantially rigid sheet material having a crease formed therein to defme first and second member portions that are yieldably positionable relative to one another about the crease and within a defined range of motion;

a cushion secured adjacent the first member portion opposite the second member portion; and a covering substantially encasing the yieldable member and the cushion.

2. The pad of claim 1, wherein the defined range comprises a range of from a first position of about zero corresponding to a relative position wherein portions of the first and second member portions are in contact with one another to a second position corresponding to a distance wherein edge portions of the first and second member portions are spaced apart from one another an amount imparted by the crease in the absence of any force being applied to the pad.

3. The pad of claim 1, wherein the member comprises a plastic sheet material.

4. The pad of claim 1, wherein the member comprises a plastic sheet material having a substantially circular or elliptical shape and a corresponding cut out, wherein the crease is formed by bending the member to urge portions of the member toward one another.

5. The pad of claim 1, wherein the cushion comprises a portion of a foam material.

6. The pad of claim 5, wherein the portion of foam material corresponds substantially in size and shape to that of the first member portion to which it is secured.

7. The pad of claim 6, wherein the foam material is secured to the first member portion by adhesive.

8. The pad of claim 1, wherein the covering comprises one or more portions of a flexible sheet material positioned to substantially encase the member and the pad.

9. The pad of claim 8, wherein the covering comprises a first covering portion having a substantially circular or elliptical shape with a correspondingly shaped central cutout and a second substantially diamond-shaped covering portion, wherein the first and second covering portions are joined to one another by stitches.

10. The pad of claim 8, wherein the covering exerts force on the first and second member portions to urge them slightly toward one another.

11. The pad of claim 1, further comprising an attachment member secured to a portion of the covering adjacent the second member portion for cooperating with a corresponding attachment member mountable to a helmet for attaching the pad to the helmet.

12. The pad of claim 11, wherein the attachment member comprises a strip of a flexible sheet material having one or more fasteners secured thereto.

13. The pad of claim 12, wherein the flexible sheet material comprises a plastic sheet material and the fasteners secured thereto comprise female snaps configured for matingly engaging male snaps securable to an interior portion of a helmet.

14. A football helmet, comprising:

a helmet shell including an interior portion having a helmet attachment member secured thereto adjacent an interior portion of the helmet; and a pad, including member comprising a substantially rigid sheet material having a crease formed therein to provide first and second member portions that are yieldably positionable relative to one another about the crease and within a defined range of motion a cushion secured adjacent the first member portion opposite the second member portion, a covering substantially encasing the yieldable member and the cushion, and a pad attachment member secured to a portion of the covering adjacent the second member portion for cooperating with the helmet attachment member for attachment of the pad to the helmet.

15. The helmet of claim 14, wherein the pad comprises a jaw pad and the helmet attachment member is located adjacent a location on the helmet so that the jaw pad may be installed for contacting a jaw area of a user wearing the helmet.

16. A method for making a pad comprising the steps of providing a yieldable member comprising donut-shaped portion of a substantially rigid, bendable sheet material, forming a crease yieldable member to substantially bisect the yieldable member and define a pair of member portions that are yieldably positionable relative to one another about the crease; securing a cushion to an outward facing portion of one of the member portions and encasing the thus formed combination of the yieldable member and cushion within a covering material.

* * * * *